US007847659B2

(12) United States Patent
Fischer et al.

(10) Patent No.: US 7,847,659 B2
(45) Date of Patent: Dec. 7, 2010

(54) COAXIAL METAMATERIAL STRUCTURE

(75) Inventors: Georg Fischer, Bavaria (DE); Erwin Ruttmann, Bavaria (DE)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 803 days.

(21) Appl. No.: 11/615,121

(22) Filed: Dec. 22, 2006

(65) Prior Publication Data

US 2008/0150649 A1 Jun. 26, 2008

(51) Int. Cl.
*H01P 3/06* (2006.01)
*H01P 1/20* (2006.01)

(52) U.S. Cl. ..... 333/206; 333/207

(58) Field of Classification Search ..... 333/254, 333/206, 207

See application file for complete search history.

(56) References Cited

U.S. PATENT DOCUMENTS 3,167,729 A 1/1965 Hall
5,812,036 A * 9/1998 Estrada ..... 333/202
6,628,180 B2 * 9/2003 Yim ..... 333/202
2003/0001697 A1 * 1/2003 Bennett et al. ..... 333/202
2003/0112101 A1 * 6/2003 Tsunoda et al. ..... 333/206
2003/0218521 A1 * 11/2003 Andoh ..... 333/206
2004/0001024 A1 1/2004 Killen et al.
2005/0168391 A1 8/2005 Ratajczak et al.
2005/0212625 A1 9/2005 Celinski et al.
2006/0178114 A1 * 8/2006 Fischer ..... 455/87

OTHER PUBLICATIONS

International Search Report and Written Opinion of the International Searching Authority for International application No. PCT/US2007/025589 mailed May 29, 2008.

* cited by examiner

*Primary Examiner*—Robert Pascal
*Assistant Examiner*—Alan Wong
(74) *Attorney, Agent, or Firm*—Carlson, Gaskey & Olds PC

(57) ABSTRACT

A metamaterial device has a coaxial structure including rotational symmetry about a longitudinal axis of coaxial conductors. In a disclosed example, a series inductance portion has a relatively smaller circumferential dimension compared to another portion of a conductor. A series capacitance portion comprises an interruption in the conductor. A shunt capacitance portion has the largest circumferential dimension of the conductor. A shunt inductance portion comprises a relatively small electrical connection between first and second conductors. A disclosed example metamaterial structure is useful, for example, as a filter in a wireless communication device.

17 Claims, 3 Drawing Sheets

COAXIAL METAMATERIAL STRUCTURE

TECHNICAL FIELD

This invention generally relates to metamaterials. More particularly, this invention relates to a coaxial metamaterial structure.

DESCRIPTION OF THE RELATED ART

Metamaterials have been under consideration for some time. Metamaterials are artificial structures that are designed to exhibit specific electromagnetic properties that are not found in a single, homogeneous existing material from nature. Metamaterial structures are intended to provide negative permittivity and permeability for realizing a so-called left-handed material.

It has been proposed to utilize microstrip materials for realizing metamaterial structures. One disadvantage associated with such arrangements is that microstrip lines tend to concentrate radio frequency current on the edges of the tracks. Accordingly, microstrip lines are subject to significant losses, which is undesirable for many applications. Other proposals have included suspended substrates in place of microstrip lines, but these arrangements also are subject to a concentration of radio frequency currents at the edges of the line tracks. Accordingly, even those structures have associated losses.

Metamaterial structures are desirable for a variety of applications. Communication equipment can be made more economical if a metamaterial structure could provide the necessary performance. For example, microstrip line configurations provide the capability of reducing the size and cost of a filter or a duplexer that includes coaxial resonators. The problem has been that the microstrip arrangements have associated losses that are too significant such that appropriate performance has not been realized.

There is a need for new and improved metamaterial structure arrangements that can provide such cost and size savings without suffering from the losses associated with previously proposed arrangements. This invention addresses that need.

SUMMARY

An exemplary metamaterial device comprises a coaxial metamaterial structure.

One disclosed example includes a first conductor and a second conductor. The second conductor has two ends. A first portion between the two ends has a first circumferential dimension. A series inductance portion between the two ends has a second circumferential dimension that is smaller than the first circumferential dimension. A series capacitance portion comprises an interruption between the two ends. A shunt capacitance portion between the two ends has a third circumferential dimension that is larger than the first circumferential dimension.

In one example, a shunt inductance portion between the two ends comprises at least one conductive connection between the first and second conductors.

In one example, at least the series inductance portion, the series capacitance portion and the shunt capacitance portion each are respectively circumferentially symmetric about a longitudinal axis of the second conductor.

In one example, the first conductor comprises two portions that are adjustably coupled together. Adjusting the relative positions of the two portions of the first conductor in one example selectively controls a spacing of the interruption of the series capacitance portion of the second conductor. In such an example, selectively adjusting the relative positions of the two portions of the first conductor allows for tuning or adjusting the capacitance of the series capacitance portion.

The various features and advantages of the disclosed examples will become apparent to those skilled in the art from the following detailed description. The drawings that accompany the detailed description can be briefly described as follows.

DETAILED DESCRIPTION

This invention provides a coaxial metamaterial structure. A coaxial metamaterial structure allows for realizing the conductive efficiencies of a coaxial conductor arrangement simultaneous with realizing the benefits of a metamaterial. In a disclosed example, various portions of a conductor function as right hand and left hand circuit equivalents for realizing a metamaterial structure.

Figure 1:
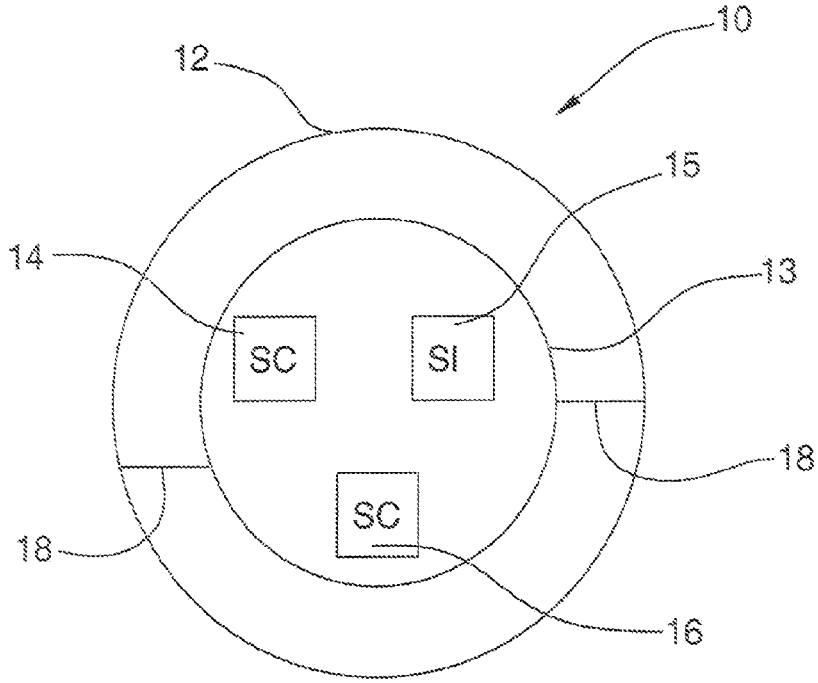
FIG. 1 schematically shows an example coaxial metamaterial structure designed according to an embodiment of this invention.

FIG. 1 schematically illustrates a coaxial metamaterial structure 10. This example includes a first, outer conductor 12 and a second, inner conductor 13. The outer conductor 12 in one example functions as a grounding shield. In this example, the inner conductor 13 comprises various portions that provide metamaterial performance. A series capacitance portion 14, a series inductance portion 15 and a shunt capacitance portion 16 are part of the second conductor 13. A shunt inductance 18 in this example comprises at least one conductive connection between the first conductor 12 and the second conductor 13.

The example shunt inductance 18 comprises a relatively thin conductive element. As can be appreciated from the drawing, it does not occupy much of the spacing between the inner and outer conductors. This type of arrangement allows for realizing a significant shunt inductance value. As the shunt inductance 18 occupies an increasing amount of the spacing between the inner and outer conductors, the amount of shorting between them increases. Given this description, those skilled in the art will be able to determine an appropriate dimension for a shunt inductance portion 18 to meet their particular needs.

In one example, the coaxial metamaterial structure 10 has electromagnetic metamaterial properties that render the structure one dimensional in a metamaterial sense. In other examples, the properties render the structure two or three dimensional in a metamaterial sense.

Figure 2:
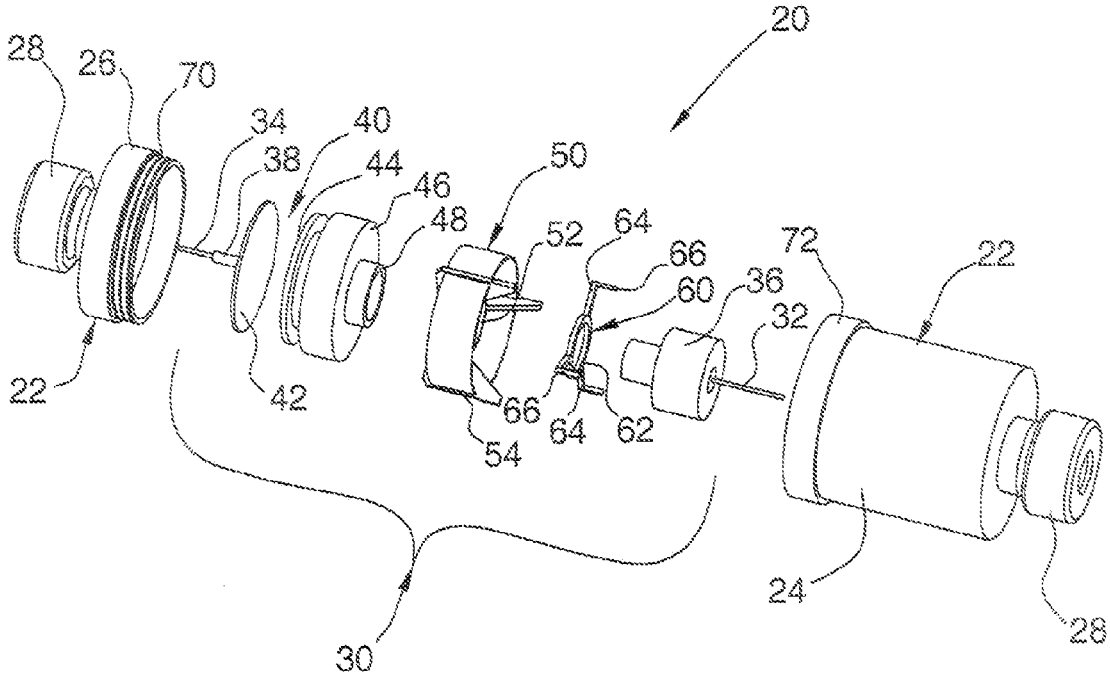
FIG. 2 is a perspective, exploded view of one example device having a coaxial metamaterial structure designed according to one embodiment of this invention.

FIG. 2 illustrates an example device 20 including a coaxial metamaterial structure 10. A first ("outer") conductor 22 in this example comprises a first portion 24 and a second portion 26. Each of the portions 24 and 26 is generally cylindrical and has a hollow interior. Connectors 28 are provided on the portions 24 and 26 of the first conductor 22 for making an appropriate connection with another conductor or another device, to meet the needs of a particular situation.

Figure 3:
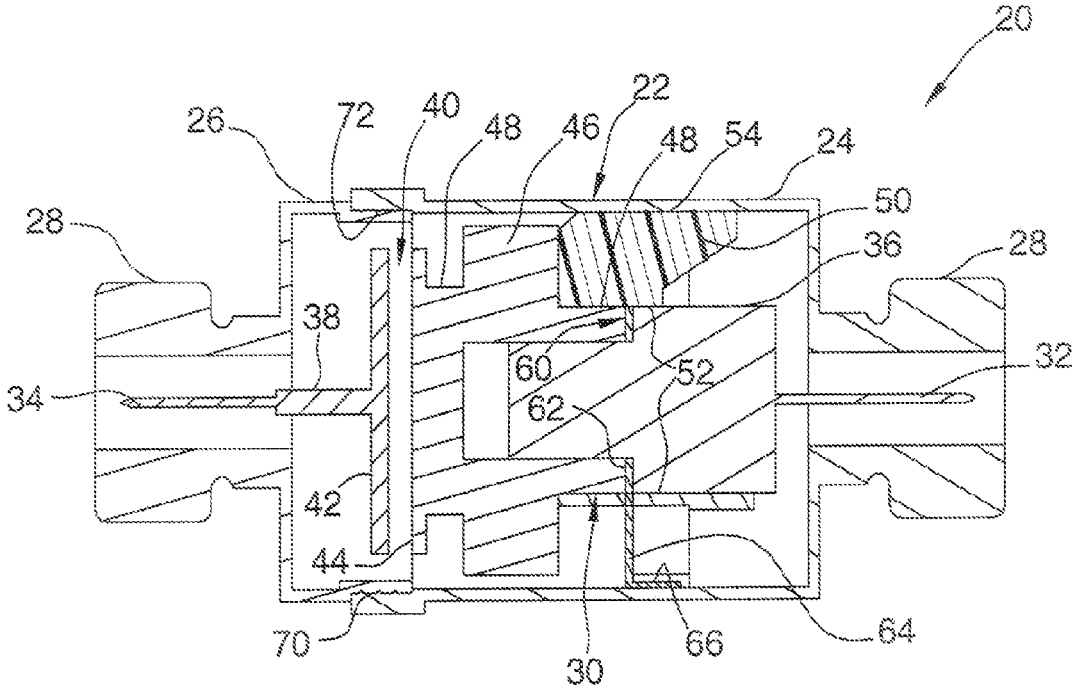
FIG. 3 is a cross-sectional illustration of the embodiment of FIG. 2.

A second ("inner") conductor 30 in this example is at least partially received within the first conductor 22. FIG. 3 illustrates an assembled condition in cross-section.

In this example, the second conductor 30 has a first end 32 and a second end 34 each of which is configured to be at least partially received within the connector portions 28 of the corresponding portions of the outer conductor 22. The ends 32 and 34 facilitate making a connection with another device or conductor where a coaxial conductor arrangement is desired.

The second conductor 30 includes a first portion 36 that has a first circumferential dimension. A series inductor portion 38 has a second, smaller circumferential dimension. As can be appreciated from the illustration, the thickness (taken in a radial direction) of the first portion 36 is substantially greater than that of the series inductance portion 38. In one example, the series inductance portion is realized or accomplished by thinning out the material of an appropriate portion of the second conductor 30 by machining it down to an appropriate outside, circumferential dimension. The specific relationship between the first circumferential dimension of the first portion 36 and the second circumferential dimension of the series inductance portion 38 will vary depending upon the particular embodiment. Those skilled in the art who have the benefit of this description will be able to select appropriate specific dimensions to meet the needs of their particular situation.

The second conductor 30 also includes a series capacitance portion 40. In this example, the series capacitance portion 40 comprises an interruption in the second conductor 30. As can be appreciated from FIGS. 2 and 3, for example, the series capacitance portion 40 includes spacing between plates 42 and 44. This spacing effectively interrupts the second conductor 30. In the illustrated example, the plates 42 and 44 have a circumferential dimension that is larger than the first circumferential dimension of the first portion 36.

A shunt capacitance portion 46 has the largest circumferential dimension of the various portions of the second conductors 30.

In this example, the shunt capacitance portion 46 is realized or accomplished by leaving a largest circumferential dimension along the shunt capacitance portion 46 and machining away intermediate portions 48 so that they each have a smaller circumferential dimension on either side of the shunt capacitance portion 46. In this example, the intermediate portions 48 each have an outside dimension that corresponds to the first circumferential dimension of the first portion 36. In the illustrated example, the plate 44 of the series capacitance portion is formed from the same piece of material that is used to form the shunt capacitance portion 46.

A non-conductive spacer 50 includes an interior opening 52 that is received at least partially over one of the intermediate portions 48 and an exterior surface 54 that is received against an inside surface on the first conductor 22. The non-conductive spacer 50 maintains a desired alignment between the first conductor 22 and the second conductor 30. In one example, the spacer 50 comprises a plastic material. In one example, the spacer 50 is molded into the desired shape.

The second conductor 30 includes a shunt inductance portion 60. In this example, the shunt inductance portion 60 comprises an inner ring 62 and a plurality of projections 64 that project away from the ring 62 in a radial direction. The projections 64 establish a conductive connection between the first conductor 22 and the second conductor 30. Tabs 66 at the end of each of the example projections 64 rest against the conductive material of the first conductor 22 as can be appreciated from FIG. 3, for example. The inner ring 62 establishes a conductive connection with the other portions of the second conductor 30.

In another example, the shunt inductance is realized without a DC conductive connection between the first and second conductors. In such an example, the shunt inductance comprises a shunt inductance in series with a capacitance that has a reactive impedance that is approximately 0 Ohms. Such an example has an AC/RF connection.

When the various portions of the metamaterial device 20 are assembled as shown in FIG. 3, the series capacitance portion 40 is between the series inductance portion 38 and the shunt capacitance portion 46. At the same time, the shunt capacitance portion 46 is between the series capacitance portion 40 and the shunt inductance portion 60.

Figure 4:
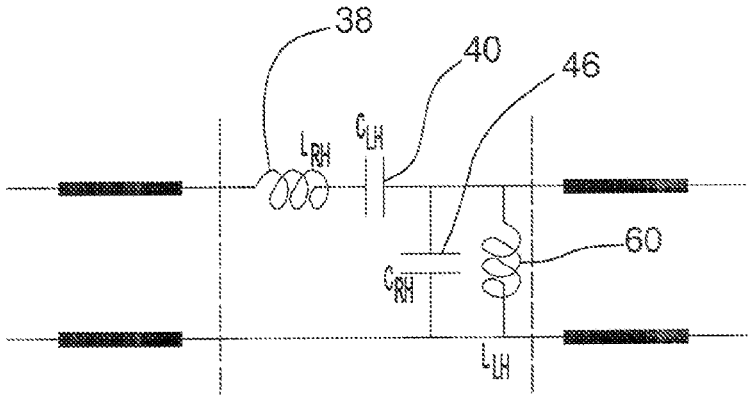
FIG. 4 is a schematic diagram showing a circuit equivalent behavior of the example embodiment of FIGS. 1 and 2.

The function of the shunt capacitance portion 46 and the series inductance portion 38 together correspond to so-called right hand performance while the performance of the series capacitance portion 40 and the shunt inductance portion 60 together correspond to the so-called left hand performance. FIG. 4 includes a schematic illustration of the circuit equivalent performance of the various portions of the embodiments of FIGS. 1 and 2.

These examples provide significant advantages compared to previous attempts at realizing metamaterial structures. As mentioned above, microstrip or planar technologies suffer from losses associated with edge current concentration. The rotationally symmetric configuration of the various portions of at least the second conductor 30 avoids such current concentrations and provide for a rotationally uniform distribution of current, which provides coaxial conductor performance while realizing the left hand and right hand performance of a metamaterial. Such an arrangement allows for realizing the size and cost savings associated with metamaterial structures while avoiding the drawbacks of undesirable losses that were present in previous arrangements that relied upon planar and microstrip arrangements.

One feature of the example of FIGS. 2 and 3 is that the portions 24 and 26 of the first conductor 22 are adjustably coupled together. In this example, exterior threads 70 on the portion 26 cooperate with interior threads 72 on the portion 24. The threads allow for rotating the portions 24 and 26 relative to each other to select an overall length of the first conductor 22. In this example, adjusting the relative positions of the portions 24 and 26 allows for controlling the spacing between the plates 42 and 44 of the series capacitance portion 40. In this example, this feature provides the significant advantage of allowing for tuning the overall device 20 by effectively selecting the capacitance of the series capacitance portion 40 by controlling the spacing between the plates 42 and 44.

In one example, the device 20 has a zero order resonance so that the mechanical length of the device does not have to depend on the frequency or wavelength of a signal intended to be propagated along at least the second conductor 30. It is possible, therefore, to utilize a single device like the illustrated device 20 for different frequencies without having to replace the entire device. This feature can be advantageous in a wireless communication system where a filter is required and different signal frequencies may be used at different times. Given this description, those skilled in the art will realize how best to tune a metamaterial device designed according to this invention to meet the needs of their particular situation.

Figure 5:
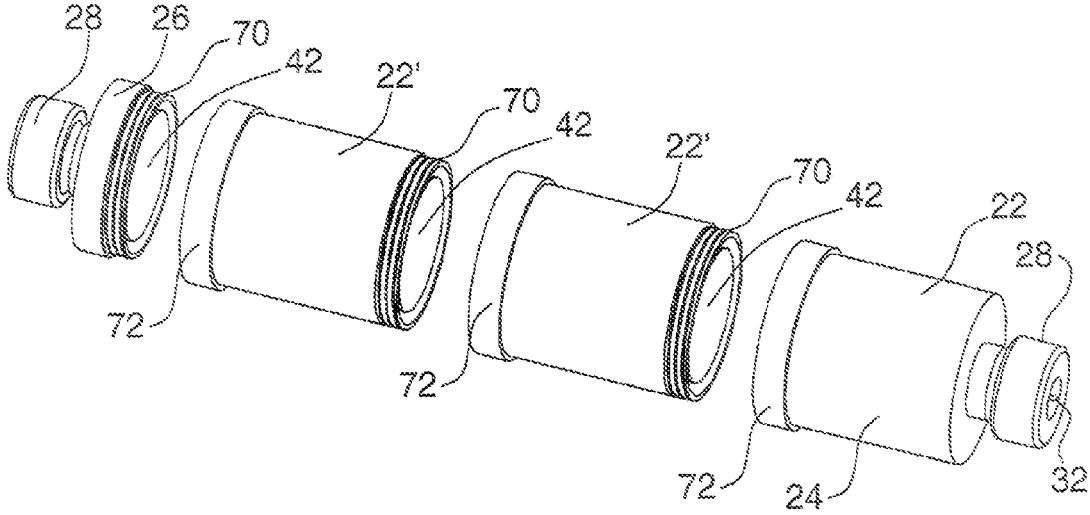
FIG. 5 is a perspective, partially exploded view of another example embodiment of a metamaterial structure.
Figure 6:
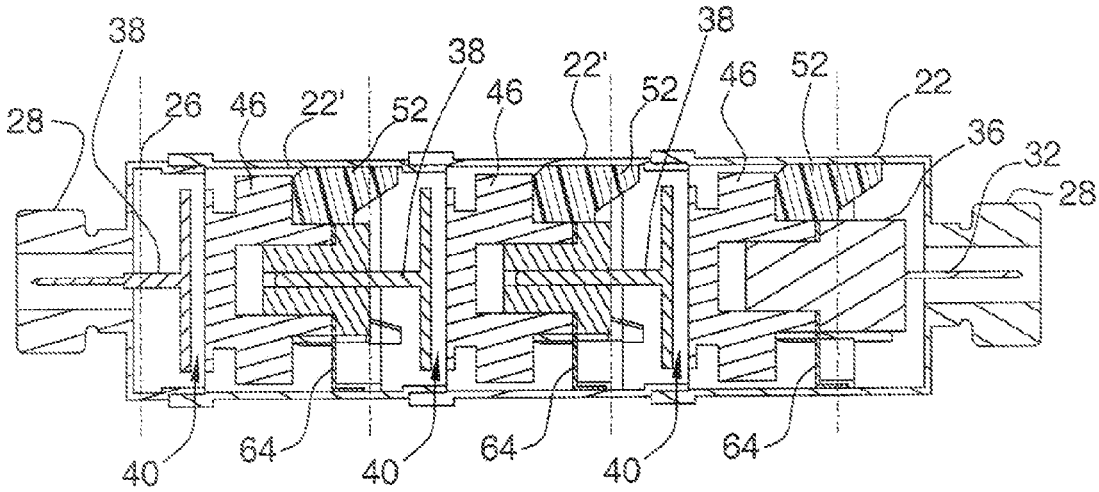
FIG. 6 is a cross-sectional view of the embodiment of FIG. 5.

FIG. 5 schematically shows another example assembly incorporating a metamaterial device like the example of FIG. 2. The example of FIG. 5 includes three such devices in series with additional outer conductor portions 22' inserted between the portions 24 and 26. As best appreciated from FIG. 6, each of the portions 22' contains a series inductance portion 38, a shunt inductance portion 64 and a shunt capacitance portion 46. Also, one of the plates of the series capacitance portion 40 is included.

In this example, three unit cells (each comprising a coaxial metamaterial structure) are combined in series for scaling performance of a device such as a filter. In the illustrated example, the dimension of each unit cell is the same. In another example, the dimension of each unit cell is not the same and a bi-periodical arrangement is accomplished by alternating unit cells of even and odd order. In one example, the even order unit cells have one dimension while the odd order unit cells have another dimension. Given this description, those skilled in the art will be able to scale a device to meet their particular needs by choosing dimensions and numbers of unit cells to meet their particular requirements.

One advantage associated with this example is that cascading a selected number of units provides convenient scalability. This feature also allows for an easy trade-off between filter selectivity and passband loss.

In one example, the length of each unit cell is relatively small compared to the wavelength of a signal intended to be propagated along the conductors. In one example, the length of the unit cell is less than 1/10 of the wavelength of a corresponding signal.

The connector portions 28 allow for the device 20 to be easily integrated into cabling of a variety of devices. Special shelving or mounting configurations are not required and this is yet another advantage of the illustrated example.

Another advantage of the example illustrated in FIGS. 2 and 3 is that it is a closed design that does not require additional shielding.

In one example, the various portions of the device 20 are made, with the exception of the spacer 50 and the shunt inductance portion 60, using a lathe or other turning machine to accomplish the various portions having rotational symmetry about the longitudinal access of the conductor. In one example, the shunt inductance portion 60 is realized through a stamping operation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A metamaterial device, comprising a coaxial metamaterial structure including a first conductor;

a second conductor having a series inductance portion, a series capacitance portion and a shunt capacitance portion; and a shunt inductance portion that comprises a shunt inductance in series with a capacitance that has a reactive impedance that is approximately 0 Ohms.

2. A metamaterial device, comprising a coaxial metamaterial structure including a first conductor;

a second conductor having a series inductance portion, a series capacitance portion and a shunt capacitance portion; and a shunt inductance portion, wherein the first conductor comprises an outer conductor, the second conductor is at least partially received within the outer conductor, and the outer conductor comprises two portions that are adjustably coupled together for selecting an overall length of the outer conductor.

3. The metamaterial device of claim 2, wherein the two portions of the outer conductor are selectively adjustable relative to each other to selectively adjust a dimension of the interruption of the series capacitance portion.

4. A metamaterial device, comprising a coaxial metamaterial structure including a first conductor;

a second conductor having a series inductance portion, a series capacitance portion and a shunt capacitance portion; and a shunt inductance portion, wherein the second conductor has a first circumferential dimension between two ends, the series inductance portion is between the two ends and has a second circumferential dimension that is smaller than the first circumferential dimension, the series capacitance portion comprises an interruption between the two ends, and the shunt capacitance portion is between the two ends and has a third circumferential dimension that is larger than the first circumferential dimension.

5. The metamaterial device of claim 4, wherein the second conductor comprises at least one other series inductance portion between the two ends that has the second circumferential dimension, at least one other series capacitance portion comprising an interruption between the two ends, at least one other shunt capacitance portion between the two ends that has the third circumferential dimension, and at least one other shunt inductance portion between the two ends comprising at least one conductive connection between the first and second conductors.

6. The metamaterial device of claim 5, wherein the device comprises a biperiodic coaxial arrangement.

7. The metamaterial device of claim 4, wherein the series capacitance portion is between the series inductance portion and the shunt capacitance portion; and the shunt capacitance portion is between the series capacitance portion and the shunt inductance portion.

8. The metamaterial device of claim 4, wherein the first conductor comprises an outer conductor, the second conductor is at least partially received within the outer conductor, and the outer conductor comprises two portions that are adjustably coupled together for selecting an overall length of the outer conductor.

9. The metamaterial device of claim 8, wherein the two portions of the outer conductor are selectively adjustable relative to each other to selectively adjust a dimension of the interruption of the series capacitance portion.

10. The metamaterial device of claim 4, wherein the series capacitance portion comprises two spaced plates each having a fourth circumferential dimension that is larger than the first circumferential dimension and smaller than the third circumferential dimension.

11. The metamaterial device of claim 4, wherein the shunt inductance portion comprises a plurality of projections each having a cross-sectional dimension that is smaller than the first circumferential dimension.

12. A metamaterial device, comprising a coaxial metamaterial structure including a first conductor;

a second conductor having a series inductance portion, a series capacitance portion and a shunt capacitance portion; and a shunt inductance portion that comprises at least one direct conductive connection between the first and second conductors.

13. The metamaterial device of claim 12, comprising a non-conductive spacer between the first and second conductors for maintaining a desired alignment of the conductors.

14. The metamaterial device of claim 12, having a zero order resonance such that a length of the conductors is independent of a frequency or wavelength of a signal intended to be propagated along the conductors.

15. The metamaterial device of claim 12, wherein each of the series capacitance portion, the series inductance portion and the shunt capacitance portion are respectively circumferentially symmetric about a longitudinal axis of the second conductor.

16. The metamaterial device of claim 12, wherein the device comprises a biperiodic coaxial arrangement.

17. The metamaterial device of claim 12, wherein the metamaterial device comprises a filter for filtering at least one signal.

* * * * *